US009038242B2

(12) United States Patent
Chung

(10) Patent No.: US 9,038,242 B2
(45) Date of Patent: May 26, 2015

(54) VERTICAL ADJUSTABLE HINGE

(71) Applicant: Union Tool Exporters, Ltd., Taipei (TW)

(72) Inventor: Stanley Chung, San Diego, CA (US)

(73) Assignee: Union Tool Exporters, Ltd., Taipei (TW)

( * ) Notice: Subject to any disclaimer, the term of this patent is extended or adjusted under 35 U.S.C. 154(b) by 0 days.

(21) Appl. No.: 13/831,764

(22) Filed: Mar. 15, 2013

(65) Prior Publication Data

US 2014/0259527 A1 Sep. 18, 2014

(51) Int. Cl.
*E05D 7/06* (2006.01)
*E05D 7/04* (2006.01)

(52) U.S. Cl.
CPC ..... *E05D 7/0415* (2013.01)

(58) Field of Classification Search
CPC ..... E05D 7/0415
USPC ..... 16/236–238, 240, 242–243, 245–246, 16/248, 235, 362–364, 105
See application file for complete search history.

(56) References Cited

U.S. PATENT DOCUMENTS

| | | | | |
|---|---|---|---|---|
| 1,920,466 | A * | 8/1933 | Haskins et al. | 16/386 |
| 4,654,929 | A * | 4/1987 | Fahnders et al. | 16/261 |
| 5,799,370 | A * | 9/1998 | Davidian et al. | 16/236 |
| 6,021,547 | A * | 2/2000 | Stagoll | 16/105 |
| 2007/0028420 | A1 * | 2/2007 | Lueffe et al. | 16/382 |
| 2011/0296652 | A1 * | 12/2011 | Zhang | 16/239 |

* cited by examiner

*Primary Examiner* — Victor Batson
*Assistant Examiner* — Matthew Sullivan
(74) *Attorney, Agent, or Firm* — Patent Law Group LLP; David C. Hsia

(57) ABSTRACT

A vertically adjustable hinge includes a first leaf rotatably connected to a leaf assembly. The leaf assembly defines an opening with at least a first inclined surface and includes a block received in the opening. The block defines a threaded hole and at least a second inclined surface abutting the first inclined surface. A leaf assembly housing receives the leaf assembly and the block. The leaf assembly housing defines screw holes for receiving a screw that passes through the threaded hole. A rotation of a screw in the threaded hole causes a horizontal translation of the block, which in turn causes a vertical translation of the leaf assembly.

16 Claims, 9 Drawing Sheets

VERTICAL ADJUSTABLE HINGE

DESCRIPTION OF RELATED ART

Door installation varies from manufacturer to manufacturer and from site to site. Thus, what is needed is a flexible hinge system that adapts to each installation.

BRIEF DESCRIPTION OF THE DRAWINGS

In the drawings.

Use of the same reference numbers in different figures indicates similar or identical elements.

DETAILED DESCRIPTION OF THE INVENTION

Figure 1:
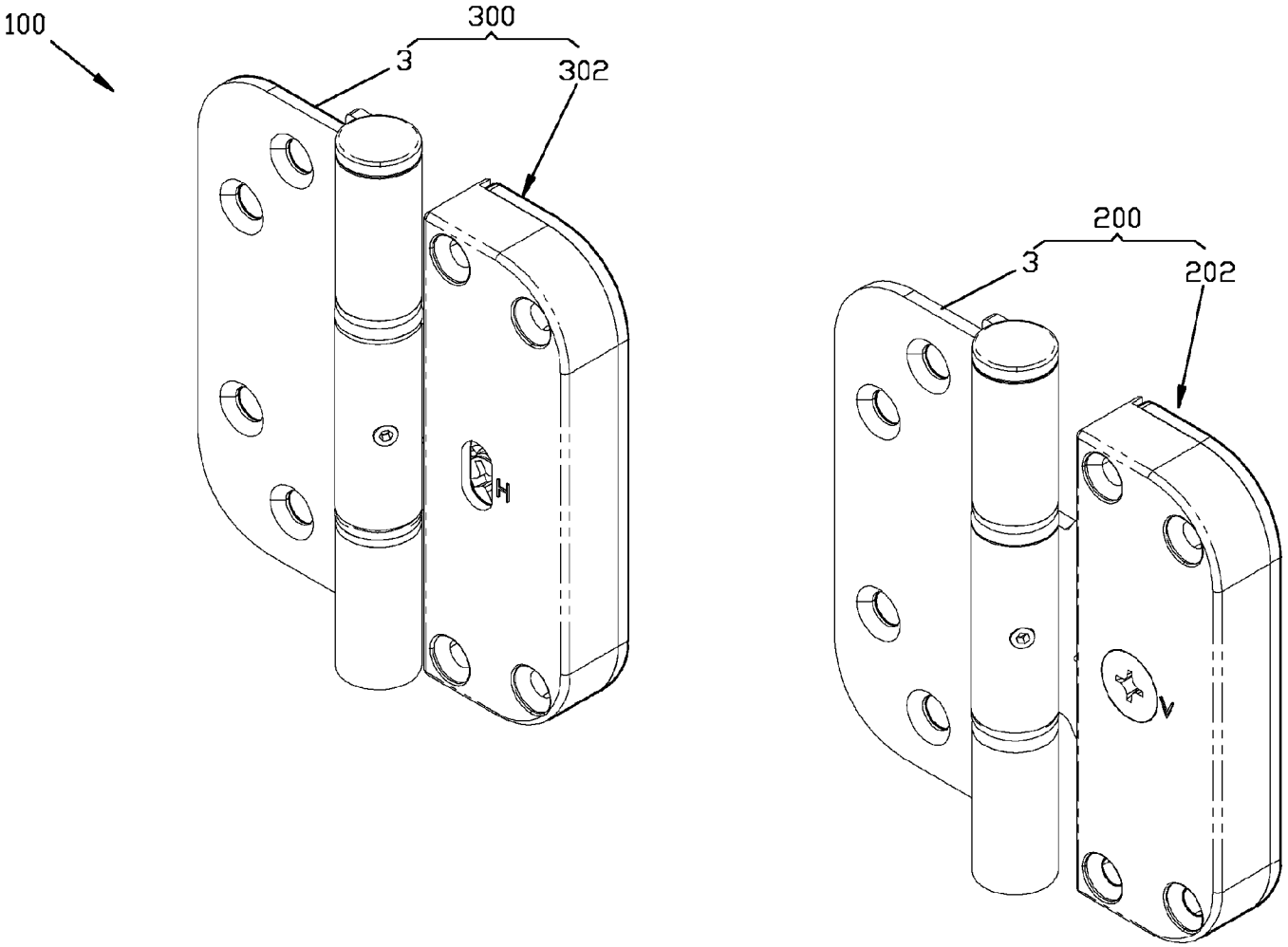
FIGS. 1 and 2 are isometric and front views of a hinge apparatus including a vertically adjustable hinge and a horizontally adjustable hinge.
Figure 2:
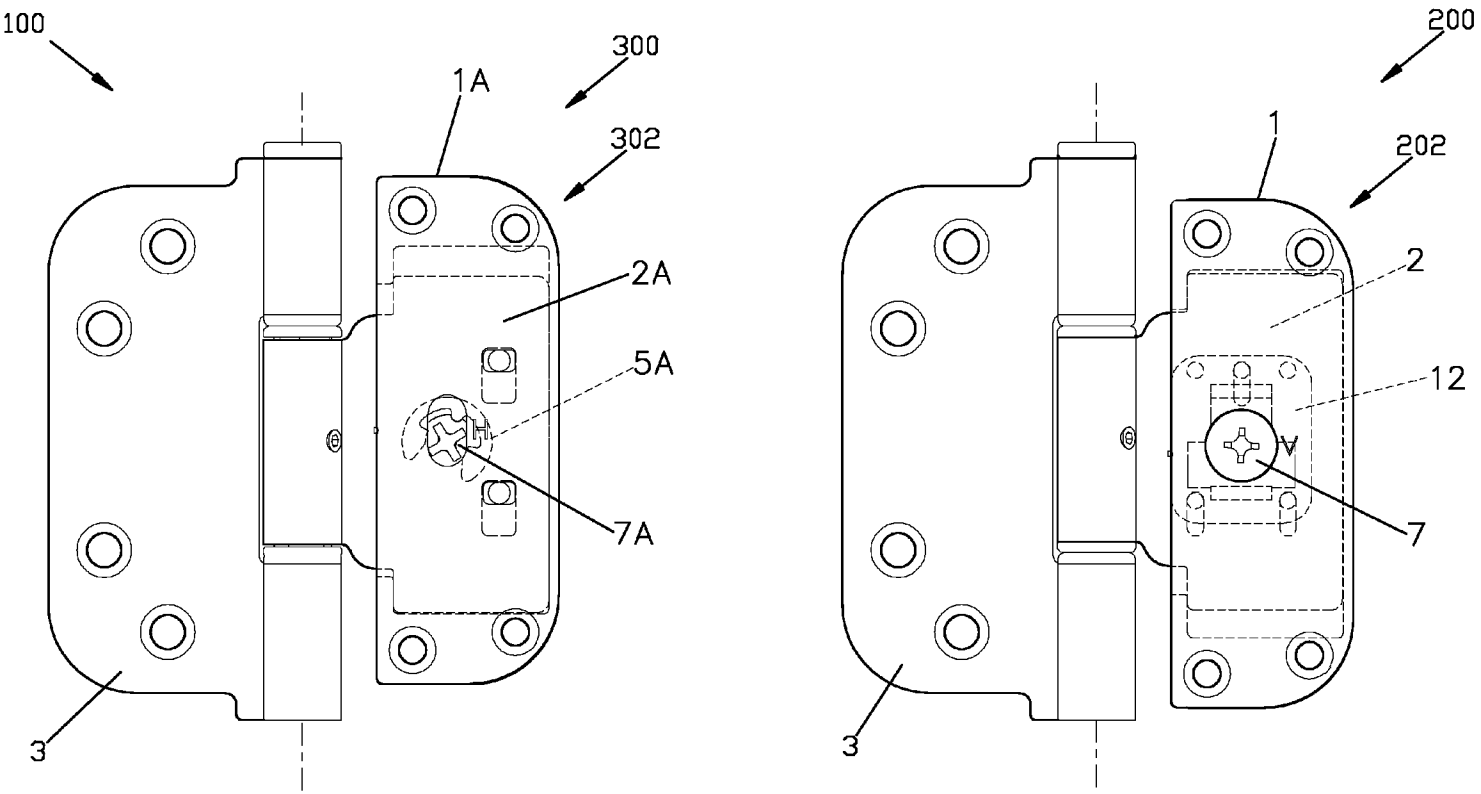

FIGS. 1 and 2 are isometric and front views of a hinge apparatus 100 including a vertically adjustable hinge 200 and a horizontally adjustable hinge 300 in one embodiment of the present disclosure. Vertically adjustable hinge 200 includes a leaf 3 and a leaf assembly 202 rotatably connected to leaf 3 so leaf assembly 202 is free to rotate relative to leaf 3 about a vertical axis. Horizontally adjustable hinge 300 includes a leaf 3 and a leaf assembly 302 rotatably connected to leaf 3 so leaf assembly 302 is free to rotate relative to leaf 3 about a vertical axis. Hinge apparatus 100 may include additional hinges 200 and/or 300.

Figure 3:
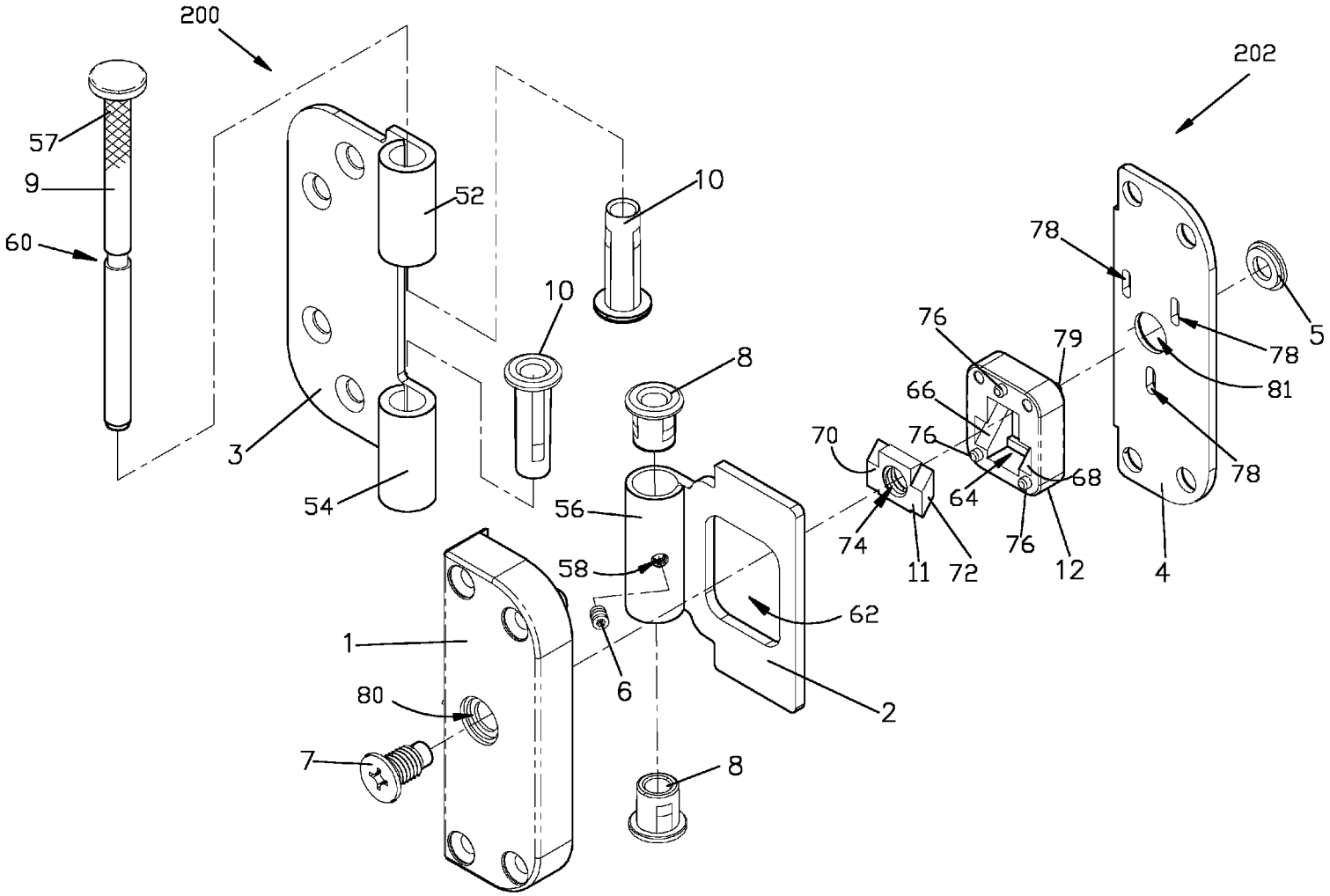
FIG. 3 is an exploded view of the vertically adjustable hinge.

FIG. 3 is an exploded view of vertically adjustable hinge 200 in one embodiment of the present disclosure. As described above, vertically adjustable hinge 200 includes leaf 3 and leaf assembly 202. Leaf 3 has an upper knuckle 52 and a lower knuckle 54. Upper knuckle 52 receives a flanged bushing 10 from its bottom opening, and lower knuckle 54 receives a flanged bushing 10 from its top opening. Bushings 10 may each have internal ribs or a constricting internal bore that press fits to a hinge pin 9. Leaf assembly 202 includes a small live leaf 2, a ramp mechanism having a guide block 12 (e.g., a vertically translatable block), a vertical adjustment block 11 (e.g., a horizontally translatable ramp), and an adjustment screw 7, and a leaf assembly housing having a housing cover 1 and a housing back plate 4. Block 12 may be an integral piece or two symmetrical pieces.

Leaf 2 has a knuckle 56 that receives flanged bushings 8 from its top and bottom openings. Bushings 8 may each have internal ribs or a constricting internal bore that press fits to hinge pin 9. Knuckle 56 of leaf 2 is received between knuckles 52 and 54 of leaf 3. In another example the knuckle arrangement is reversed so leaf 3 has a knuckle received between two knuckles of leaf 2. Hinge pin 9 is inserted through knuckle 52, 56, and 54. Hinge pin 9 may have a knurled section 57 that is received in bushing 10 of knuckle 52 to prevent the hinge pin from working itself loose from leaves 2 and 3. Knuckle 56 may define a threaded hole 58 for receiving a hex key 6, and hinge pin 9 may have a circumferential groove 60. When screwed in, hex key 6 extends into groove 60 to prevent hinge pin 9 from being removed. Access to hex key 6 is only available from the interior of a structure. Leaf 2 defines a leaf opening 62 for receiving block 12. Leaf 2 is free to translate horizontally relative to block 12 so vertically adjustable hinge 200 accommodates horizontal adjustments from horizontally adjustable hinge 300. Alternatively block 12 is integrated with leaf 2.

Blocks 11 and 12 form a ramp mechanism that translates horizontal movement of one into a vertical movement of the other. One of blocks 11 and 12 is limited to horizontal movement while the other is limited to vertical movement. When the vertically limited element translates horizontally, the horizontally limited element translates vertically. Depending on the implement, only block 11 or 12 has one or more inclined surfaces or both blocks 11 and 12 have corresponding inclined surfaces.

In one example, block 12 defines a block opening 64 for receiving block 11. Block opening 64 has one or more inclined surfaces that rest against one or more inclined surfaces of block 11. The thickness of block 12 confines it horizontally within the leaf assembly housing. However, block 12 can be translated vertically within the leaf assembly housing. The inclined interface between blocks 11 and 12 transforms a horizontal movement of block 11 into a vertical movement of block 12. In one example, block 11 has inclined tongues 70 and 72 formed on its two sides, and block 12 has two inclined grooves 66 and 68 formed on two sides of block opening 64 for receiving inclined tongues 70 and 72 of block 11. Block 11 defines a threaded hole 74 for receiving screw 7.

Housing cover 1 and housing back plate 4 of the leaf assembly housing define vertical guides for block 12. In one example, housing cover 1 has a vertical surface with vertical slots (not visible) that receive pins 76 protruding from the front of block 12, and housing back plate 4 has a vertical surface with vertical slots 78 that receive pins 79 (only one is visible) protruding from the back of block 12. The vertical surface of housing cover 1 defines a screw hole 80 providing access to threaded hole 74 of block 11. The vertical surface of housing back plate 4 defines a screw hole 81 opposite screw hole 80. Screw 7 may have a stepped cylindrical head and screw hole 80 may have multiple counterbores that receive the stepped cylindrical head to allow screw 7 to rotate freely.

Screw 7 is inserted through screw hole 80, threaded through threaded hole 74, and has an end spin riveted to a washer 5 in screw hole 81. Washer 5 may be a stepped washer and screw hole 81 may be a counterbored screw hole that allows washer 5 to rotate freely. Screw 7 is able to rotate in place to horizontally translate block 11 relative to the leaf assembly housing. Screw 7 and washer 5 spin together. Washer 5 prevents housing back plate 4 from being pushed out by block 11. Blocks 11 and 12 are prevented from rotating in place as block 11 fits in block 12, and block 12 is constrained from rotating by its pin-in-slot interface with the leaf assembly housing.

Figures 4A, 4B, 4C, 4D:
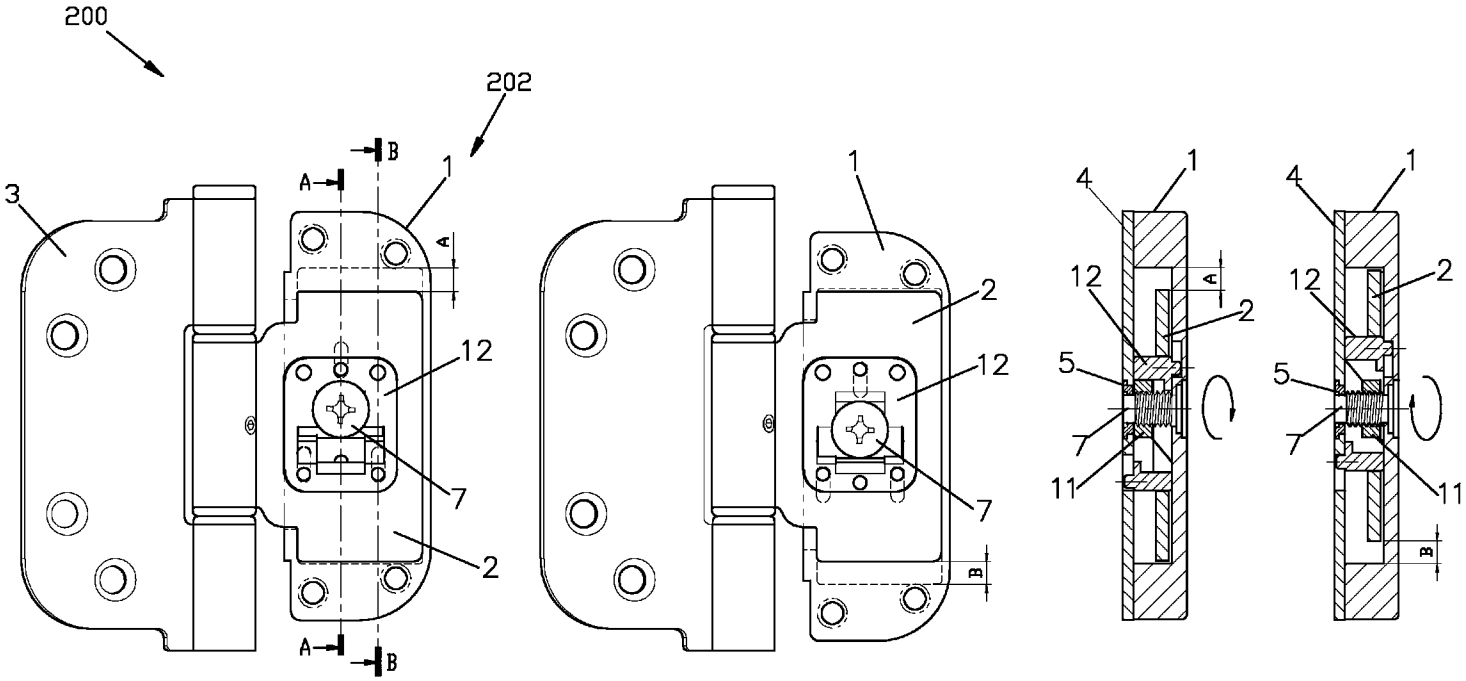
FIG. 4A is a front view of the hinge of FIG. 3.
FIG. 4B is a side cross-sectional view of the hinge of FIG. 3.
FIG. 4C is a front view of the hinge of FIG. 3.
FIG. 4D is a side cross-sectional view of the hinge of FIG. 3.
Figure 5A:
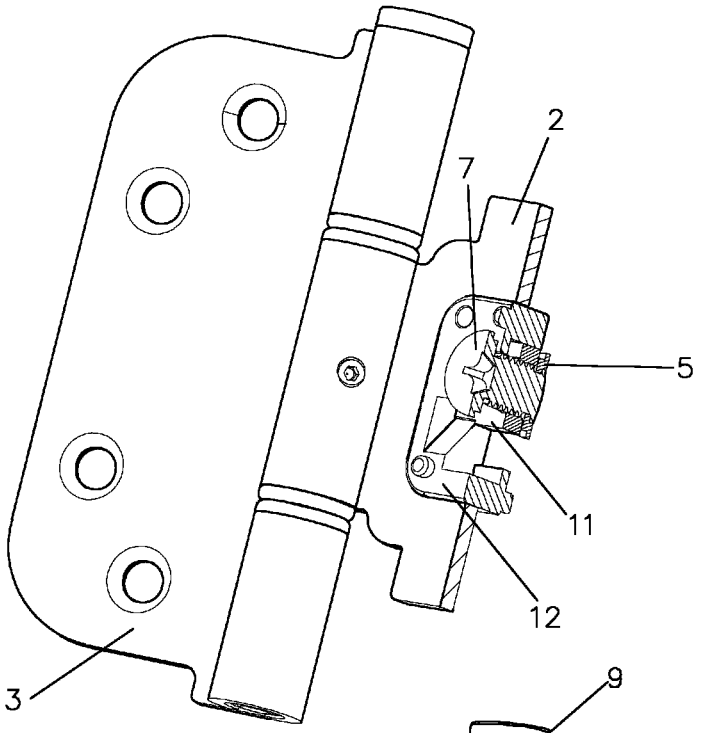
FIGS. 5A and 5B are isometric views of FIGS. 4B and 4D.
Figure 5B:
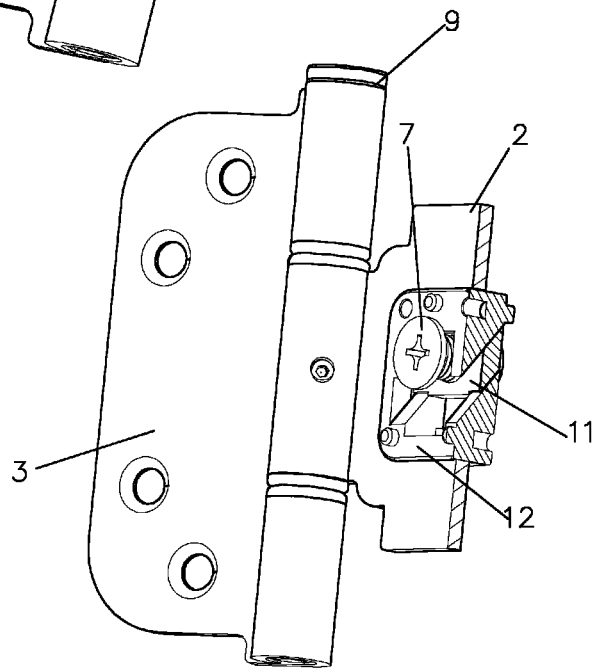

FIG. 4A is a front view of vertically adjustable hinge 200 with part of housing cover 1 removed to show leaf 2, block 12, and screw 7 in one embodiment of the present disclosure. As shown in FIG. 4A, block 12 and leaf 2 are initially located at the lowest vertical position. FIG. 4B is a cross-sectional side view of vertically adjustable hinge 200 taken along line AA in FIG. 4A in one embodiment of the present disclosure. As shown in FIG. 4B, block 11 is initially located at the back of the leaf assembly housing against housing back plate 4. FIGS. 5A and 5B are cross-sectional isometric views of vertically adjustable hinge 200 taken along lines AA and BB, respectively, in FIG. 2A in one embodiment of the present disclosure.

Figure 6:
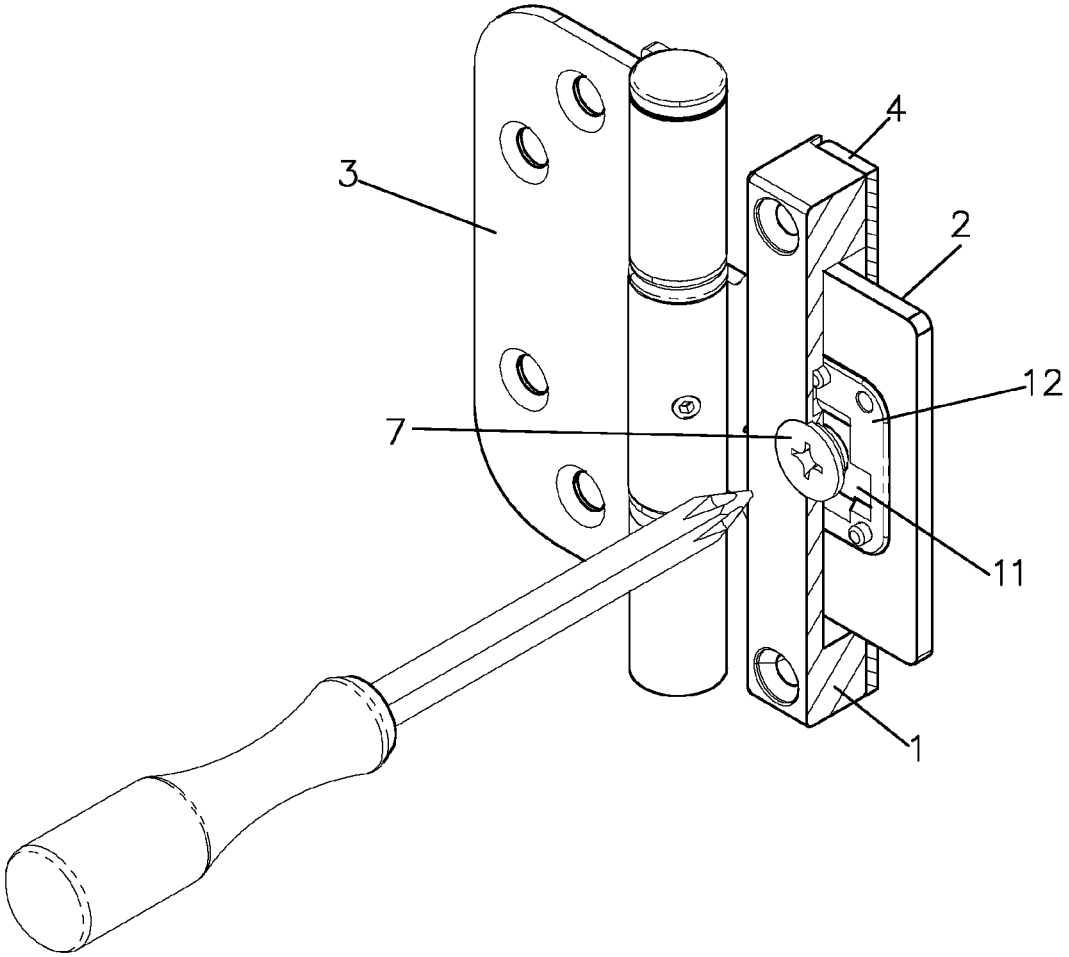
FIG. 6 is an isometric partial cross-sectional view of the hinge of FIG. 4A.

To adjust vertically adjustable hinge 200, screw 7 is rotated as shown in FIG. 6. Referring back to FIGS. 4A and 4B, the rotation of screw 7 causes a horizontal translation of block 11 relative to the leaf assembly housing, which in turn causes a vertical translation of block 12, leaf 2, and leaf 3 relative to the leaf assembly housing. As shown in FIG. 4C, block 12 and leaf 2 are now located at the highest vertical position. As shown in FIG. 4D, block 11 is now located at the front of the leaf assembly housing against housing cover 1.

Figure 7:
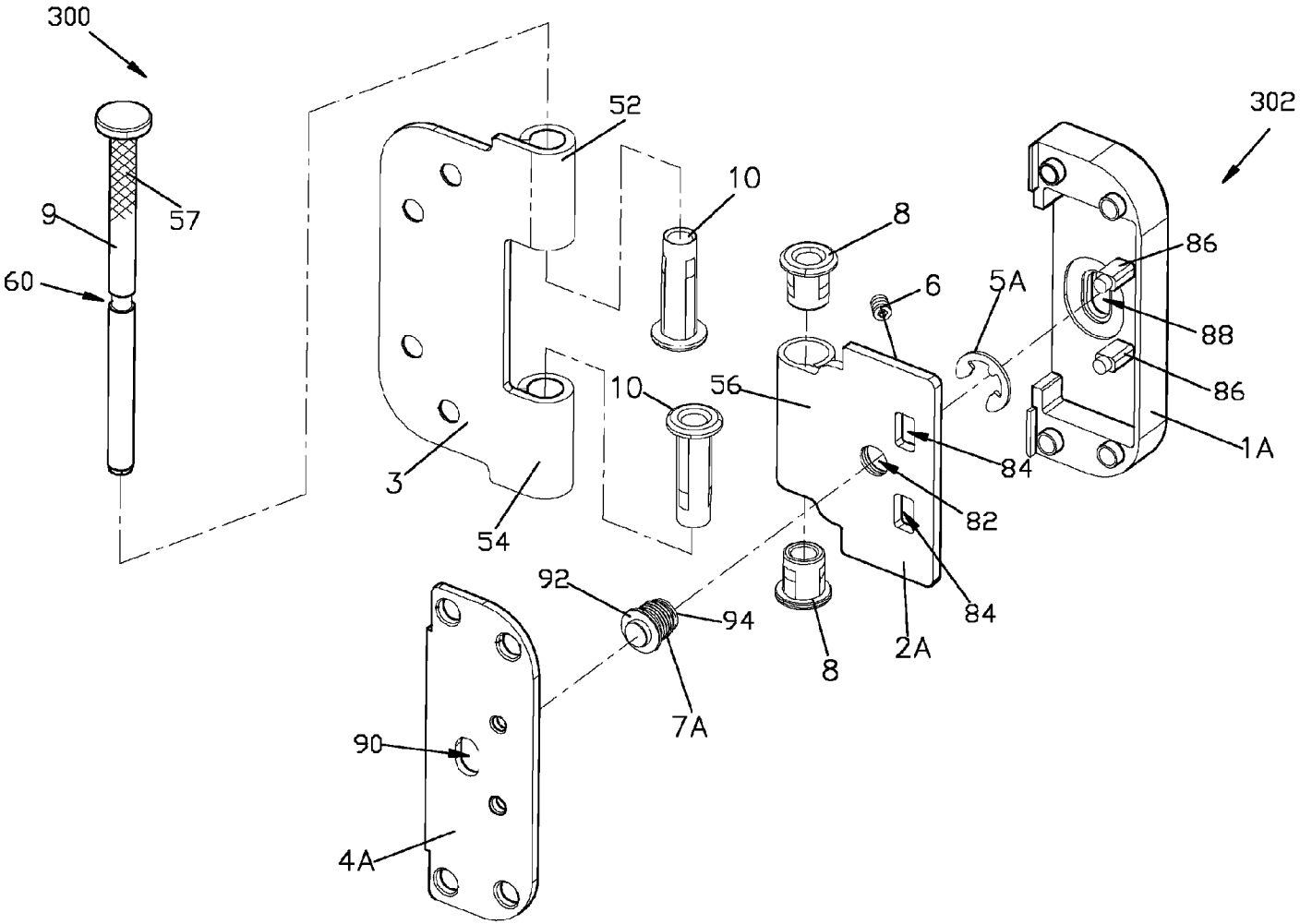
FIG. 7 is an exploded view of a horizontally adjustable hinge.

FIG. 7 is an exploded view of horizontally adjustable hinge 300 in one embodiment of the present disclosure. As described above, horizontally adjustable hinge 300 includes leaf 3 and leaf assembly 302. Leaf assembly 302 includes a small live leaf 2A, an adjustment screw 7A, a leaf assembly housing having a housing cover 1A and a housing back plate 4A.

Leaf 2A has a knuckle 56 that receives flanged bushings 8 from its top and bottom openings. Knuckle 56 defines a threaded hole 58 (not visible) for receiving a hex key 6. Knuckle 56 of leaf 2A is received between knuckles 52 and 54 of leaf 3. Hinge pin 9 with circumferential groove 60 is inserted though knuckle 52, 56, 54 and secured by hex key 6. Leaf 2A defines a threaded hole 82 for receiving screw 7A. Leaf 2A defines rectangular slots 84 for receiving posts 86 from housing cover 1A, which guides the horizontal movement of leaf 2A within the leaf assembly housing while allowing vertical movement of leaf 2A within the leaf assembly housing to accommodate vertical adjustments from vertically adjustable hinge 200 (FIG. 5).

Housing cover 1A and housing back plate 4A define vertical guides for screw 7A. In one example, housing cover 1A has a vertical surface with a counterbored vertical slot 88, and housing back plate 4A has a vertical surface with a counterbored vertical slot 90.

Screw 7A has a flanged end 92 and a grooved end 94. Screw 7A is threaded through threaded hole 82 of leaf 2A and grooved end 94 is secured by a circlip 5A. Circlip 5A prevents housing 1A from being pushed out by leaf 2A. Circlip 5A and flanged end 92 also serves as stops for leaf 2A. Ends 92 and 94 of screw 7A are received in counterbored vertical slots 88 and 90 of housing cover 1A and housing back plate 4A, respectively, so screw 7A is free to translate vertically relative to the leaf assembly housing to accommodate vertical adjustments from vertically adjustable hinge 200 (FIG. 5). Counterbored vertical slot 88 also provides access to a drive feature (e.g., a crosshead) on grooved end 94 for rotating screw 7A. Screw 7A is able to rotate in place to horizontally translate and adjust leaf 2A relative to the leaf assembly housing.

Figure 8B:
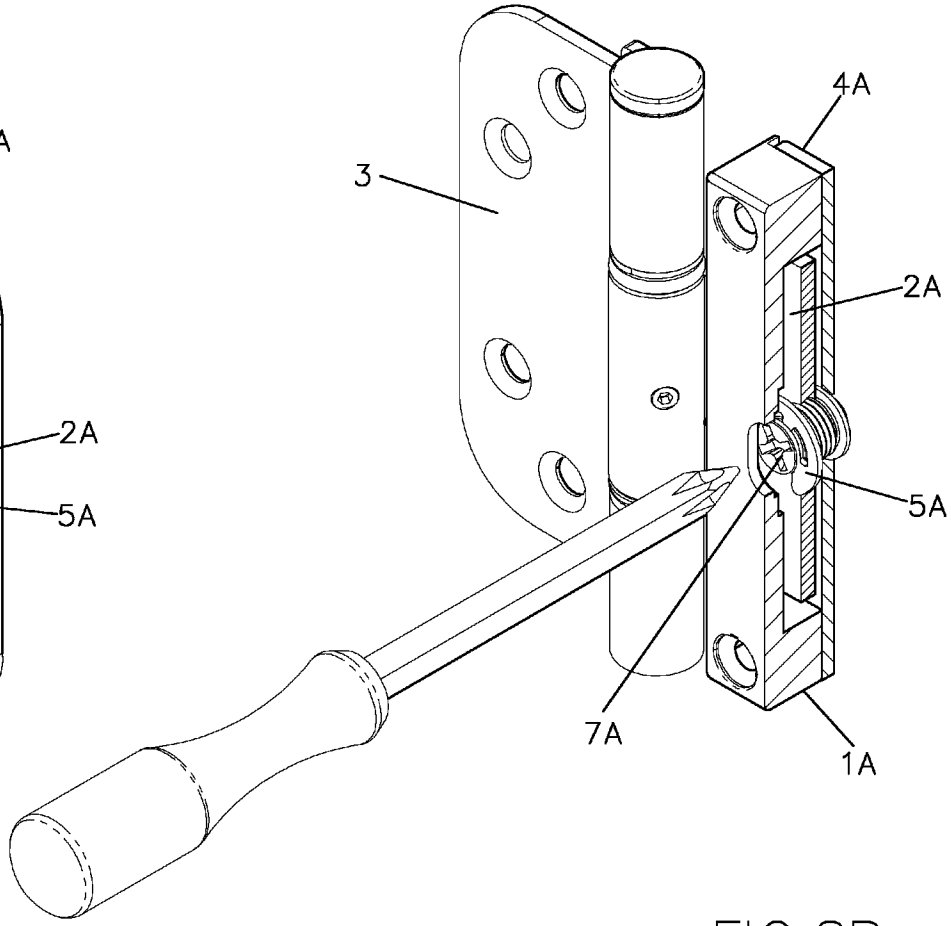
FIGS. 8A and 8B are cross-sectional views of the hinge of FIG. 7.
Figure 8A:
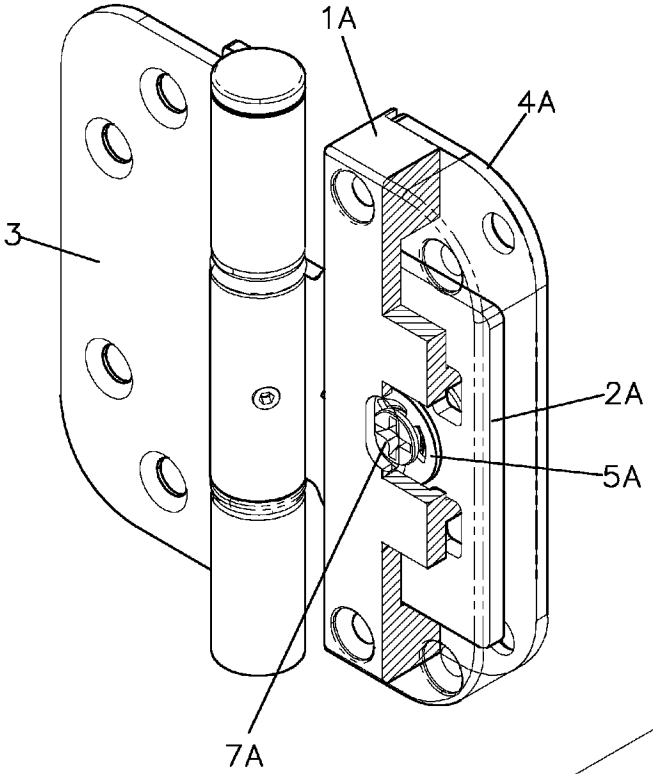

FIG. 8A is an isometric view of horizontally adjustable hinge 300 with housing cover 1A shown in phantom and cutaway to show leaf 2A, circlip 5A, and screw 7A in one embodiment of the present disclosure. FIG. 8B is an isometric cross-sectional view of horizontally adjustable hinge 300 in one embodiment of the present disclosure. To adjust horizontally adjustable hinge 300, screw 7A is rotated as shown in FIG. 8B. The rotation of screw 7A causes a horizontal translation of leafs 2A and 3 relative to the leaf assembly housing.

Figure 9:
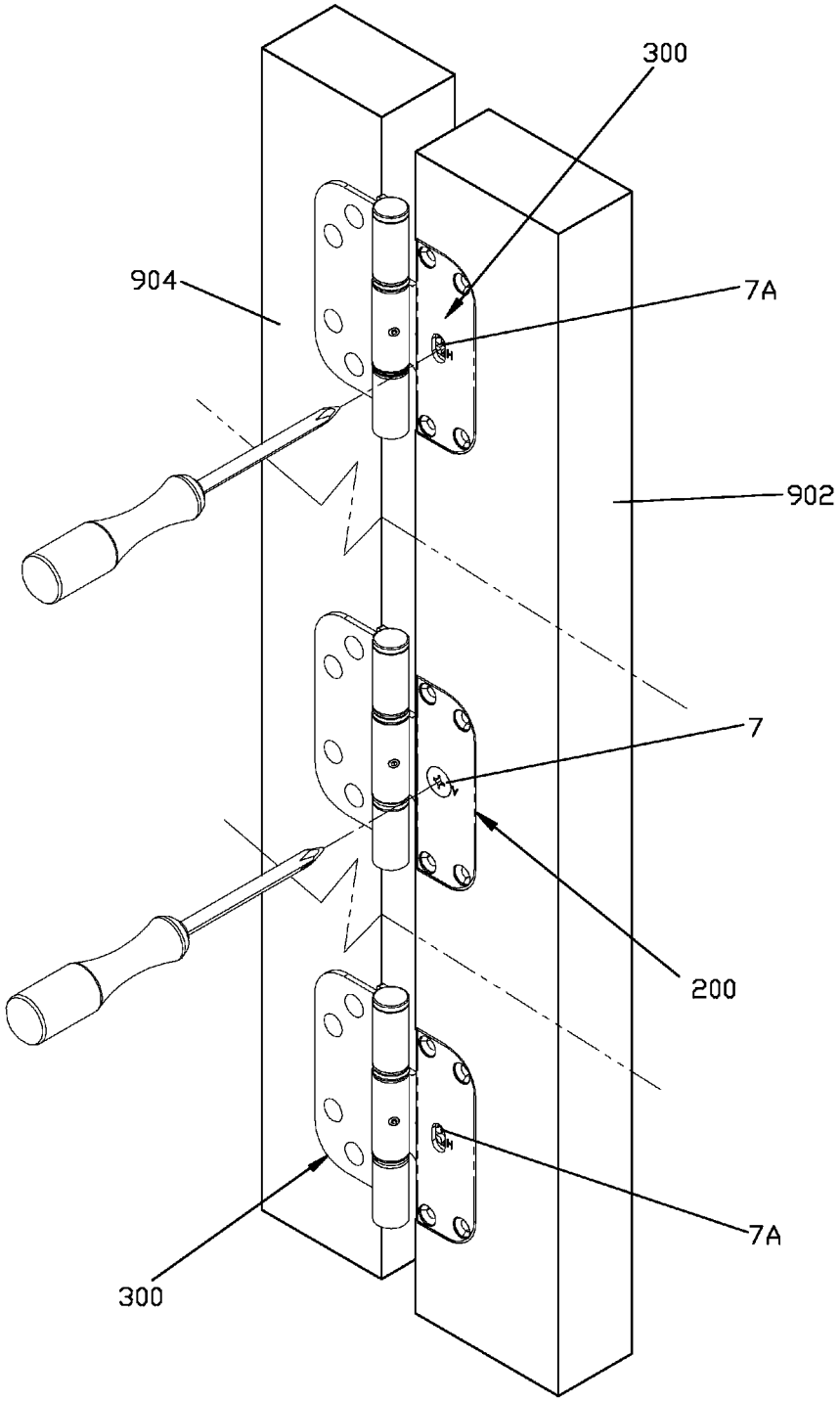
FIG. 9 illustrates a door installation using the hinges of FIGS. 3 and 7, all arranged according to embodiments of the present disclosure.

FIG. 9 illustrates a door installation 900 in one embodiment of the present disclosure. A door sash 902 and a door frame 904 are rotatably connected at the top with a horizontally adjustably hinge 300, at the middle with a vertically adjustable hinge 200, and at the bottom with another horizontally adjustable hinge 300. To vertically adjust sash 902 relative to frame 904, screw 7 of vertically adjustable hinge 200 is turned. Horizontally adjustable hinges 300 do not hinder this vertical adjustment as they are free to vertically translate. To horizontally adjust sash 902 relative to frame 904, screws 7A of horizontally adjustable hinges 300 are turned. Vertically adjustable hinges 200 do not hinder this horizontal adjustment as it is free to vertically translate.

Various other adaptations and combinations of features of the embodiments disclosed are within the scope of the invention. Numerous embodiments are encompassed by the following claims.

The invention claimed is:

1. A hinge apparatus, comprising:

a vertically adjustable hinge, comprising:

a first leaf;

a second leaf rotatably connected to the first leaf so the first and the second leafs are free to rotate relative to each other about a vertical axis;

a first block defining a block opening with at least a first inclined surface;

a second block received in the block opening, the second block defining at least a second inclined surface supporting the first inclined surface of the first block, the second block defining a threaded hole, wherein:

the block opening comprises two walls defining inclined grooves;

the second block comprises two walls with inclined tongues received in the inclined grooves of the block opening;

a leaf housing receiving the second leaf, the first block, and the second block, the leaf housing having first and second vertical surfaces with vertical guides for the first block so the first block is vertically translatable relative to the leaf housing, the first vertical surface defining a first screw hole providing access to the threaded hole of the second block, the second vertical surface defining a second screw hole opposite the first screw hole; and a screw passing horizontally through the first screw hole of the leaf housing, the threaded hole of the second block, and the second screw hole of the leaf housing, wherein a rotation of the screw causes a horizontal translation of the second block relative to the leaf housing, which in turn causes a vertical translation of the first block, the second leaf, and the first leaf relative to the leaf housing.

2. The hinge apparatus of claim 1, wherein the first block is integrated with the second leaf or the second leaf defines a leaf opening for receiving the first block so the second leaf is free to translate horizontally relative to the first block.

3. The hinge apparatus of claim 1, wherein the screw comprises a stepped cylindrical head and the first screw hole comprises counterbores for receiving the stepped cylindrical head.

4. The hinge apparatus of claim 1, wherein the screw comprises an end spin riveted to a stepped washer and the second screw hole comprises a counterbored screw hole for receiving the stepped washer.

5. The hinge apparatus of claim 1, wherein:

the first block defines first and second pluralities of pins; and the vertical guides comprise a first plurality of vertical slots on the first vertical surface for receiving the first plurality of pins and a second plurality of vertical slots on the second vertical surface for receiving the second plurality of pins.

6. The hinge apparatus of claim 1, further comprising bushings and a hinge pin with a knurled section, wherein the first and second leafs comprise knuckles receiving the bushings, the hinge pin is inserted through the knuckles, and the knurled section is received by a bushing in a knuckle to prevent the hinge pin from working free.

7. A hinge apparatus, comprising:

a vertically adjustable hinge, comprising:

a first leaf;

a second leaf rotatably connected to the first leaf so the first and the second leafs are free to rotate relative to each other about a vertical axis;

a first block defining a block opening with at least a first inclined surface;

a second block received in the block opening, the second block defining at least a second inclined surface supporting the first inclined surface of the first block, the second block defining a first threaded hole;

a leaf housing receiving the second leaf, the first block, and the second block, the leaf housing having first and second vertical surfaces with vertical guides for the first block so the first block is vertically translatable relative to the leaf housing, the first vertical surface defining a first screw hole providing access to the first threaded hole of the second block, the second vertical surface defining a second screw hole opposite the first screw hole;

a screw passing horizontally through the first screw hole of the leaf housing, the first threaded hole of the second block, and the second screw hole of the leaf housing, wherein a rotation of the screw causes a horizontal translation of the second block relative to the leaf housing, which in turn causes a vertical translation of the first block, the second leaf, and the first leaf relative to the leaf housing;

a hex key; and a hinge pin with a circumferential groove, wherein the first and second leafs comprise knuckles, one of the knuckles defines a second threaded hole, the hinge pin is inserted through the knuckles, and the hex key is screwed through the second threaded hole and into the circumferential groove.

8. A hinge apparatus, comprising:

a vertically adjustable hinge, comprising:

a first leaf;

a second leaf rotatably connected to the first leaf so the first and the second leafs are free to rotate relative to each other about a vertical axis;

a first block defining a block opening with at least a first inclined surface;

a second block received in the block opening, the second block defining at least a second inclined surface supporting the first inclined surface of the first block, the second block defining a threaded hole;

a leaf housing receiving the second leaf, the first block, and the second block, the leaf housing having first and second vertical surfaces with vertical guides for the first block so the first block is vertically translatable relative to the leaf housing, the first vertical surface defining a first screw hole providing access to the threaded hole of the second block, the second vertical surface defining a second screw hole opposite the first screw hole; and a screw passing horizontally through the first screw hole of the leaf housing, the threaded hole of the second block, and the second screw hole of the leaf housing, wherein a rotation of the screw causes a horizontal translation of the second block relative to the leaf housing, which in turn causes a vertical translation of the first block, the second leaf, and the first leaf relative to the leaf housing; and a horizontally adjustable hinge, comprising:

a third leaf;

a fourth leaf rotatably connected to the third leaf so the third and the fourth leafs are free to rotate relative to each other, the second leaf defining an other threaded hole;

an other screw screwed through the other threaded hole; and an other leaf housing receiving the fourth leaf and the other screw, the other leaf housing having third and fourth vertical surfaces with other vertical guides receiving first and second ends of the other screw so the other screw is free to translate vertically relative to the leaf housing, wherein a rotation of the other screw causes a horizontal translation of the fourth and the third leafs relative to the leaf housing.

9. The hinge apparatus of claim 8, wherein the other vertical guides comprise a first counterbored vertical slot in the third vertical surface for receiving the first end of the other screw and a second counterbored vertical slot in the fourth vertical surface for receiving the second end of the other screw.

10. The hinge apparatus of claim 9, further comprising a circlip, wherein the second end comprises a grooved end for receiving the circlip, the circlip is received in the second counterbored vertical slot, the first end comprises a flanged end, and the flanged end is received in the first counterbored vertical slot.

11. The hinge apparatus of claim 8, further comprising a hex key and a hinge pin with a circumferential groove, wherein the third and the fourth leafs comprise knuckles, one of the knuckles defines an additional threaded hole, the hinge pin is inserted through the knuckles, and the hex key is screwed through the additional threaded hole and into the circumferential groove.

12. The hinge apparatus of claim 8, further comprising an other horizontally adjustable hinge.

13. A vertical adjustable hinge, comprising:

a first leaf; and a leaf assembly rotatably connected to the leaf, the leaf assembly comprising:

a ramp;

a block on the ramp, wherein one of the ramp and the block is only horizontally translatable and the other one is only vertically translatable and coupled to the leaf;

a screw threaded horizontally through the one of the ramp and the block;

a housing receiving the ramp, the block, and the screw, wherein a rotation of the screw causes a horizontal translation of the one of the ramp and the block relative to the housing, which in turn causes a vertical translation of the other of the ramp and the block and the first leaf relative to the housing; and a second leaf rotatably connected to the first leaf so the first and the second leafs are free to rotate relative to each other, the second leaf defining a leaf opening receiving the block, the second leaf being free to translate horizontally relative to the block;

wherein:

the block defines a block opening for receiving the ramp; and the ramp comprises inclined tongues and the block comprises inclined slots for receiving the inclined tongues.

14. The hinge of claim 13, wherein the ramp comprises a threaded hole for receiving the screw.

15. The hinge of claim 14, wherein the housing comprises vertical guides that limit the block to vertical translation.

16. The hinge of claim 15, wherein the housing comprises screw holes that receive two ends of the screw, and the screw limits the ramp to horizontal translation.

* * * * *